US006302782B1

(12) United States Patent
Yip

(10) Patent No.: US 6,302,782 B1
(45) Date of Patent: Oct. 16, 2001

(54) ELECTRIC EXHAUST FANS

(76) Inventor: Chung Lun Yip, The Hong Kong Special Administrative Region 3rd Floor, Blocks A & C, King Yip Factory Building, No. 59 King Yip Street, Kwon Tong, Kowloon (HK)

( * ) Notice: Subject to any disclaimer, the term of this patent is extended or adjusted under 35 U.S.C. 154(b) by 0 days.

(21) Appl. No.: 09/478,166

(22) Filed: Jan. 5, 2000

(51) Int. Cl.[7] ..... F24F 7/013
(52) U.S. Cl. ..... 454/208; 454/351
(58) Field of Search ..... 454/208, 210, 454/212, 227, 351, 352

(56) References Cited

U.S. PATENT DOCUMENTS 1,792,514 * 2/1931 Spear ..... 454/351
2,339,363 * 1/1944 Sutcliffe et al. ..... 454/351
6,048,263 * 4/2000 Uchida et al. ..... 454/121

FOREIGN PATENT DOCUMENTS 60-88892 * 5/1985 (JP) ..... 454/351
1-181027 * 7/1989 (JP) ..... 454/208
1-291035 * 11/1989 (JP) ..... 454/208

* cited by examiner

*Primary Examiner*—Harold Joyce
(74) *Attorney, Agent, or Firm*—Brinks Hofer Gilson & Lione

(57) ABSTRACT

An electric exhaust fan has generally conventional components and is normally mounted in a window pane in known manner. The fan has a door, consisting of two rotatably mounted shells 14 and 15, that closes off a front face 11 of the fan. The door is opened and closed by a motor 24 that has a drive gear 23. The drive gear 23 engages gearing 14A and 15A formed on respective side walls of the shells. Opposite side walls of the shells have gearing 14B and 15B that mesh with one another. Also, the door remains open, once it has been fully opened, without requiring to supply power to the motor 24 to keep the door open.

6 Claims, 2 Drawing Sheets

Fig. 1
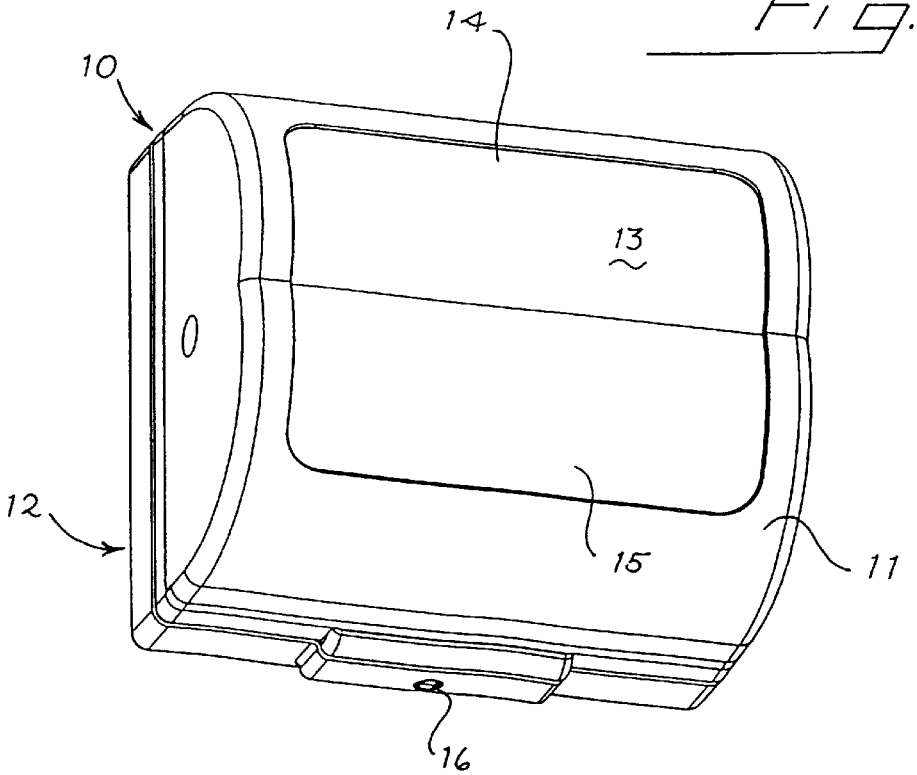
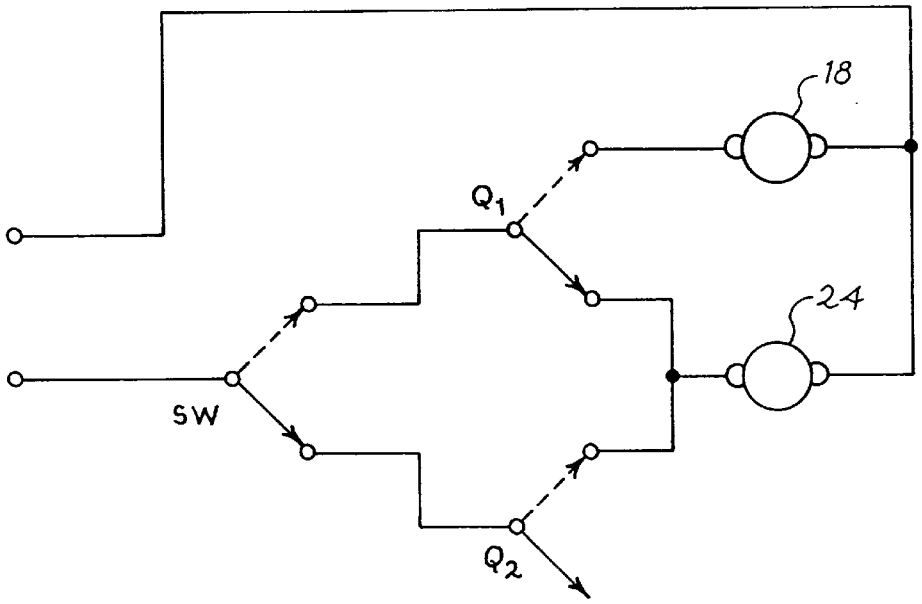
Fig. 3

ELECTRIC EXHAUST FANS

BACKGROUND OF THE INVENTION

1. Field of the Invention

The invention relates to electric exhaust fans.

2. Description of Prior Art

The invention relates more particular to exhaust fans that have closable doors to close off the exhaust outlet when the fan is not in use. In present day fans, the closable doors each comprise a slatted closure that is opened by a solenoid that is turn ON when the fan is operating. The door is normally closed by a spring that closes the door when power to the fan and the solenoid is turned OFF. This means that power is supplied to the solenoid while fan is running and requires that the solenoid to be of high quality or the solenoid soon becomes unserviceable. Additionally, the slatted door is not aesthetically attractive and thus fans, which are often fitted in window panes, render the normal view through the window inherently unappealing.

SUMMARY OF THE INVENTION

It is an object of the invention to overcome or at least reduce these problems.

According to the invention there is provided an electric exhaust fan having a housing with a front face and a rear face, an air passage extending between the front face and the rear face, a fan and a first electric drive motor for the fan mounted in the passage, an electric switch circuit to turn the fan ON and OFF, and a door to close off the passage adjacent the front face, in which the door comprises two opposing half shells each mounted to rotate about a respective horizontal axis and having abutting sides that meet together and extend in a common plane horizontally across the passage, and a second electric motor mechanically coupled and arranged to rotate the two shells in opposite direction through approximately 90° to fully open the passage whenever the fan is turned ON.

The second motor may be a reversible motor that is arranged to rotate the shells to close off the passage whenever the first motor is turned OFF.

The shells are preferably convexly arcuate in a direction from the housing towards the front face.

The shells may be each formed with gearing along one respective side wall and the second electric motor has a rotor with a gear that engages the gearing of each shell for rotating the shells.

Each shell may be formed with gearing on a respective opposite side wall, and the shells are mounted so that the opposite side wall gearings mesh with one another.

A water collection channel may be provided under a lower one of the shells to collect any water that falls on the lower shell when the door is open, and a bottom drain in the housing that communicates with the channel to drain away the water.

BRIEF DESCRIPTION OF THE DRAWING

An electric exhaust fan according to the invention will now be described by way of example with reference to the accompanying drawings in which:

FIG. 1 is a perspective front view of an electric exhaust fan embodying the invention;

FIG. 3 is a control circuit diagram for the fan of FIG. 1.

DESCRIPTION OF THE PREFERRED EMBODIMENTS

Figure 2:
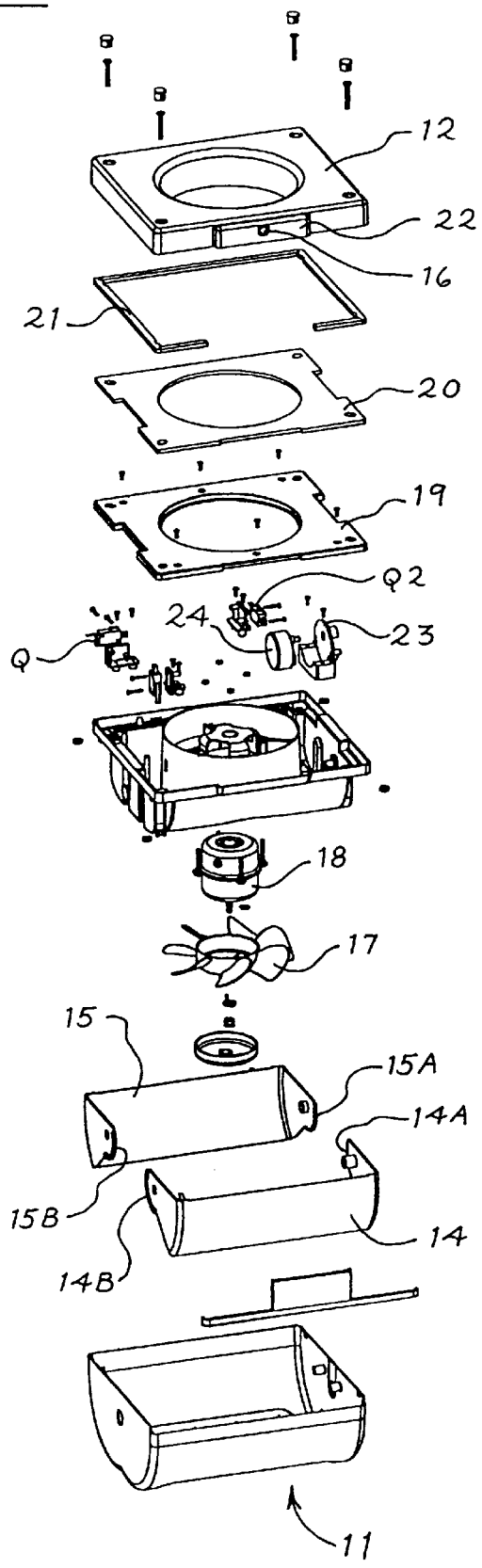
FIG. 2 is an exploded perspective view of the fan of FIG. 1.

Referring to the drawings, in FIG. 1 an electric exhaust fan comprises a housing 10 having a front face 11 and a rear face 12. An internal passage extends between the front and rear faces 11 and 12 and is closed off by a door 13. The door 13 comprises two rotatably mounted shells 14 and 15. The shells 14 and 15 are convexly arcuate as shown in the drawings and abut against one another along a horizontal central plane. A drain hole 16 is provided in a lower surface of the housing 10.

In FIG. 2, the components of the exhaust fan comprise for the most part conventional exhaust fan components including a fan 17, a first electric motor 18, and spacers 19 and 20. The spacers 19 and 20 normally fit against opposite sides of a window pane to hold the fan 17 in position. A gasket 21 is also generally conventional except in this case its lower side is discontinuous to allow water, that in use may collect in a channel 22, to drain out of the drain hole 16.

The shells 14 and 15 are each integrally formed along one side wall with gearing 14A and 15A. A gear 23 connected to the rotor of a second electric motor 24 engages both the gearing 14A and 15A to rotate the shells 14 and 15 in opposite directions. The shells 14 and 15 are rotatably supported in the housing 10 about respective horizontal axes, so that when the shells 14 and 15 are rotated by approximately 90° the air passage in the front face 11 is fully open. The shells 14 and 15 are also each integrally formed with gearing 14B and 15B along another respective opposite side wall. When the shells 14 and 15 are mounted to the housing 10, the gearing 14B and 15B mesh with one another to aid the opening and closing of the door 13 by acting against one another in a turning manner as the second motor 24 is operated.

Reference is also made to FIG. 3 for an electrical control circuit of the subject exhaust fan, which includes a main switch SW and two micro-switches Q1 and Q2 connected between a mains power source and the motors 18 and 24 as shown. The initial states of the three switches are shown by the solid lines, which correspond to the OFF condition of the exhaust fan.

When the exhaust fan is turned ON by means of the main switch SW, power is immediately supplied to the second motor 24 via the micro-switch Q2 to open the door 13, but the first motor 18 and hence the fan 17 will remain inoperative. The micro-switches Q1 and Q2 are positioned adjacent the shells 14 and 15 for simultaneous operation by them when the door 13 reaches a fully opened condition. At such time, the micro-switch Q2 will change state to cut off power supply to the door motor 24, and the other micro-switch Q1 will change state to supply power to the fan motor 18 in order to drive the fan 17 for normal operation.

When the exhaust fan is subsequently turned OFF by means of the main switch SW, power is immediately supplied to the door motor 24. The door motor 24 is a bi-directional motor designed to rotate in the reverse direction when it meets resistance in the original direction, which is the present situation with the door 13 being in the fully open condition. Accordingly, the door motor 24 will rotate in the opposite direction to close the door 13. When the door 13 is initially closed for an angle of about 2°, it will change the state of the micro-switch Q1 for cutting off the power previously supplied to the fan motor 18 and the fan 17 will stop. When the door 13 reaches the fully closed condition, it will change also the state of the other micro-switch Q2, whereby the door 13 will stop. Finally, the exhaust fan and the three switches return to the initial OFF conditions.

The described exhaust fan has an aesthetically pleasing appearance when the door 13 is closed and also obscures the fan 17 itself from the view of the user. Normally, the door 13 will remain open without the need to supply power to the motor 24, once the door 13 is fully open.

In other words, during normal operation when the fan 17 is running, electric power is not required to keep the door 13 open and the motor 24 is at rest during such periods. The door 13 will remain open because the flow of air through the fan 17 will tend to urge the shells 14 and 15 apart. More importantly, the shells 14 and 15 are positively prevented from closing by the stationary gear 23.

Nevertheless, it is possible to arrange for the door 13 to be closed in use by a spring or other biassing means. In such an arrangement, when the fan 17 is turned OFF, a biassing force is released and arranged to overcome the "free-wheeling" resistance of the motor 24 so that the gear 23 is turned and the door 13 closed under the action of the spring.

It will be noted that when the door 13 is fully open, a lower shell 15 will provide a water collection tray. In practice, any water that collects on the shell 15 drains into the channel 22 and can exit via the drain hole 16 to outside of the window pane.

I claim:

1. An electric exhaust fan having a housing with a front face and a rear face, an air passage extending between the front face and the rear face, a fan and a first electric drive motor for the fan mounted in the passage, an electric switch circuit to turn the fan ON and OFF, and a door to close off the passage adjacent the front face, in which the door comprises two opposing half shells each mounted to rotate about a respective axis and having abutting sides that meet together and extend in a common plane horizontally across the passage, and a second electric motor mechanically coupled and arranged to rotate the two shells in opposite direction through approximately 90° to fully open the passage whenever the fan is turned ON.

2. An electric exhaust fan according to claim 1, in which the second motor is a reversible motor that is arranged to rotate the shells to close off the passage whenever the first motor is turned OFF.

3. An electric exhaust fan according to claim 1, in which the shells are convexly arcuate in a direction from the housing towards the front face.

4. An electric exhaust fan according to claim 1, in which the shells are each formed with gearing along one respective side wall and the second electric motor has a rotor with a gear that engages the gearing of each shell for rotating the shells.

5. An electric exhaust fan according to claim 4, in which each shell is formed with gearing on a respective opposite side wall, and the shells are mounted so that the opposite side wall gearings mesh with one another.

6. An electric exhaust fan according to claim 1, including a water collection channel under a lower one of the shells to collect any water that falls on the lower shell when the door is open, and a bottom drain in the housing that communicates with the channel to drain away the water.

* * * * *